US008656520B2

(12) United States Patent
Rush, III

(10) Patent No.: US 8,656,520 B2
(45) Date of Patent: Feb. 25, 2014

(54) ATHLETIC HELMET

(76) Inventor: Gus A. Rush, III, Meridian, MS (US)

( * ) Notice: Subject to any disclaimer, the term of this patent is extended or adjusted under 35 U.S.C. 154(b) by 1243 days.

(21) Appl. No.: 11/882,570

(22) Filed: Aug. 2, 2007

(65) Prior Publication Data

US 2009/0031479 A1 Feb. 5, 2009

(51) Int. Cl.
*A63B 71/10* (2006.01)

(52) U.S. Cl.
USPC ..... 2/425; 2/424; 2/422

(58) Field of Classification Search
USPC ..... 2/410, 411, 414, 422, 424, 425, 9
See application file for complete search history.

(56) References Cited

U.S. PATENT DOCUMENTS 3,729,745 A * 5/1973 Latina ..... 2/9
3,854,146 A * 12/1974 Dunning ..... 2/9
5,353,437 A * 10/1994 Field et al. ..... 2/462
5,687,426 A * 11/1997 Sperber ..... 2/411
6,381,757 B2 5/2002 Rush, III
6,442,766 B1 * 9/2002 Arai ..... 2/422
6,499,147 B2 * 12/2002 Schiebl et al. ..... 2/425

* cited by examiner

*Primary Examiner* — Shelley Self
*Assistant Examiner* — Andrew Sutton
(74) *Attorney, Agent, or Firm* — Pillsbury Winthrop Shaw Pittman, LLP

(57) ABSTRACT

An improved athletic helmet comprises an outer shell having an interior and an exterior surface, an inner liner attached to the interior of the outer shell, and a face mask attached to the exterior of the outer shell. In an embodiment, the face mask engages within a recess in the exterior surface of the outer shell for receiving the face mask. The face mask may comprise a flange for engaging the recess and attaching the face mask to the outer shell. Preferably, the flange of the face mask is substantially flush with the exterior of the outer shell. In one embodiment, the inner liner comprises a viscoelastic foam. In another embodiment, the face mask comprises a lightweight magnesium material.

16 Claims, 8 Drawing Sheets

ATHLETIC HELMET

BACKGROUND OF THE INVENTION

1. Field of Invention

The present invention is generally related to an improved athletic helmet. More particularly, the present invention provides an improved athletic helmet made of lighter and stronger materials, a liner with improved energy dissipation, a lighter face mask for improved helmet balance, and an improved attachment method for a face mask.

2. Background

The use of helmets in a variety of different sports, such as football or hockey, for example, is well known. The purpose of the helmet is to protect a wearer's head from injury during participation in a sporting event, such as when a force is directed toward the head.

The National Operating Committee on Standards for Athletic Equipment (NOCSAE) establishes performance standards and tests for protective athletic equipment such as helmets. Athletic helmets typically have a hard outer shell that covers an inner layer of energy absorbing material for placing in contact with the head of a wearer or user. The hard outer shell of most sport helmets typically comprises a molded plastic material, such as polycarbonate or ABS plastic. The inner layer is intended to cooperate with the outer shell to minimize the amount of energy transmitted to a user's head, such as when the helmet is hit or impacted. The NOCSAE tests performed on the helmet determine if the outer shell and inner liner are sufficient for protecting a user's head.

Some helmets use one-piece inflatable liners to provide some degree of impact protection or elasticity. Inflatable liners, however, may provide an imprecise fit on the wearer's head and may be subject to pressure variation as temperature changes. Also, inflatable liners may rebound energy with the head (rather than absorb it).

The face masks of a helmet are mostly made of hard and heavy materials such as titanium, stainless steel or carbon steel. These materials may provide adequate protection during impact; however, they tend to add weight to the helmet. Generally, a helmet requires a user to use his own strength for balance due to the weight of the helmet. The additional weight of the face mask to the helmet causes the center of gravity of the helmet to be towards the front of the helmet, and may result in a "heads down" posture causing misalignment of the head and cervical spine.

Despite the ability of existing athletic helmets to protect a user's head from impact or injury, design improvements can be made to the helmet to provide the lightest helmet possible.

SUMMARY OF THE INVENTION

One aspect of the invention provides a helmet comprising an outer shell, an inner liner, and a face mask. The outer shell has an interior and an exterior surface. The inner liner is attached to the interior of the outer shell. The face mask has an attachment portion that is attached to a recess in the exterior of the outer shell. The attachment portion of the face mask and the recess in the exterior surface of the outer shell are constructed and arranged such that an exterior surface of the attachment portion and the exterior surface of the outer shell are substantially flush.

Another aspect of the invention provides a helmet comprising an outer shell, an inner liner, and a face mask. The outer shell has an interior and an exterior. The inner liner is attached to the interior of the outer shell. The face mask is attached to the exterior of the outer shell. The inner liner is a viscoelastic foam material and absorbs force applied to the helmet upon impact.

One aspect of the invention provides a helmet comprising an outer shell, an inner liner, and a face mask. The outer shell has an interior and an exterior. The inner liner is attached to the interior of the outer shell. The face mask is attached to the exterior of the outer shell and comprises a magnesium material.

Other objects, features, and advantages of the present invention will become apparent from the following detailed description, the accompanying drawings, and the appended claims.

DETAILED DESCRIPTION OF THE PREFERRED EMBODIMENT(S) OF THE INVENTION

Figure 1:
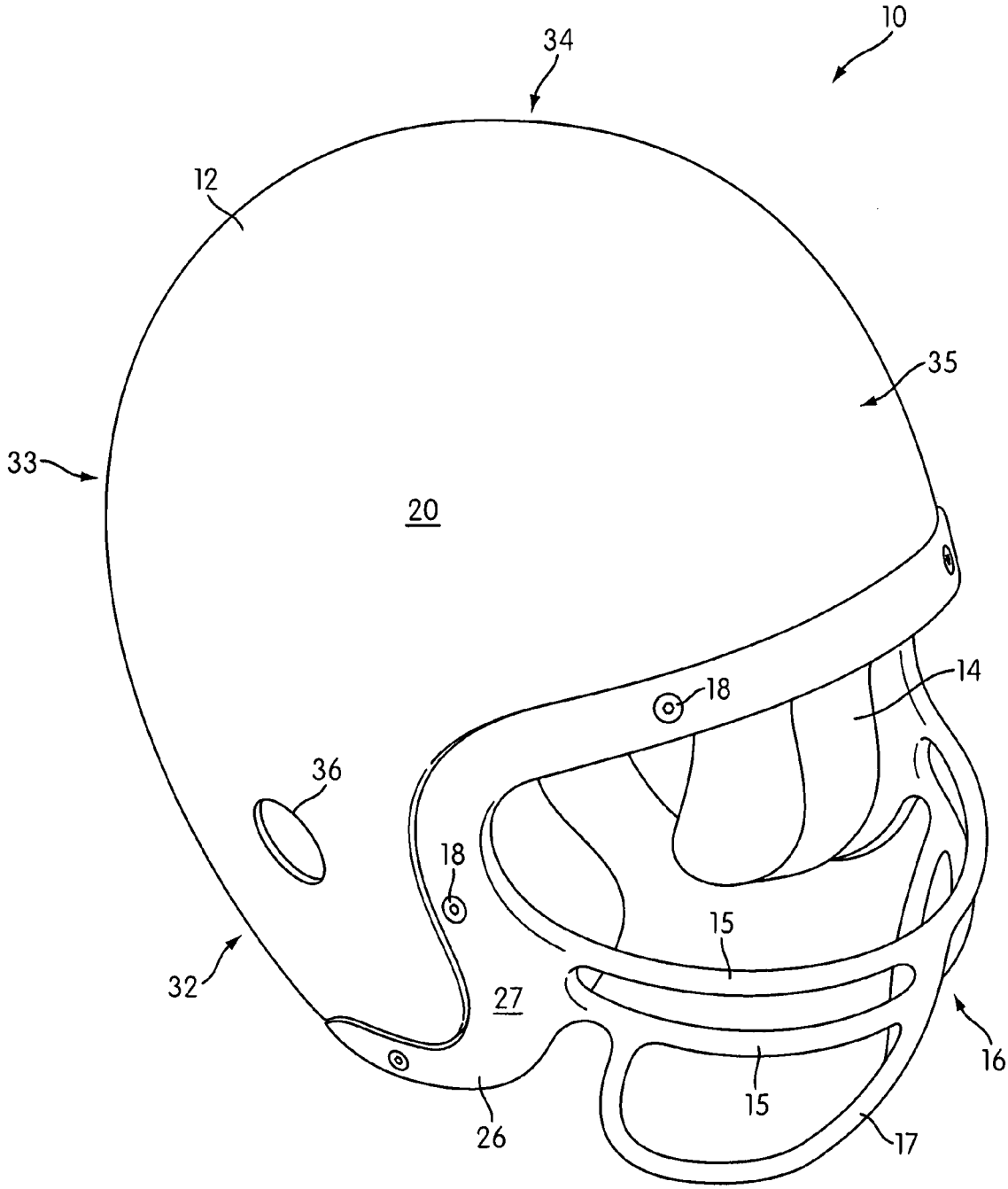
FIG. 1 is a perspective view of an improved athletic helmet in accordance with an embodiment of the present invention.
Figure 2:
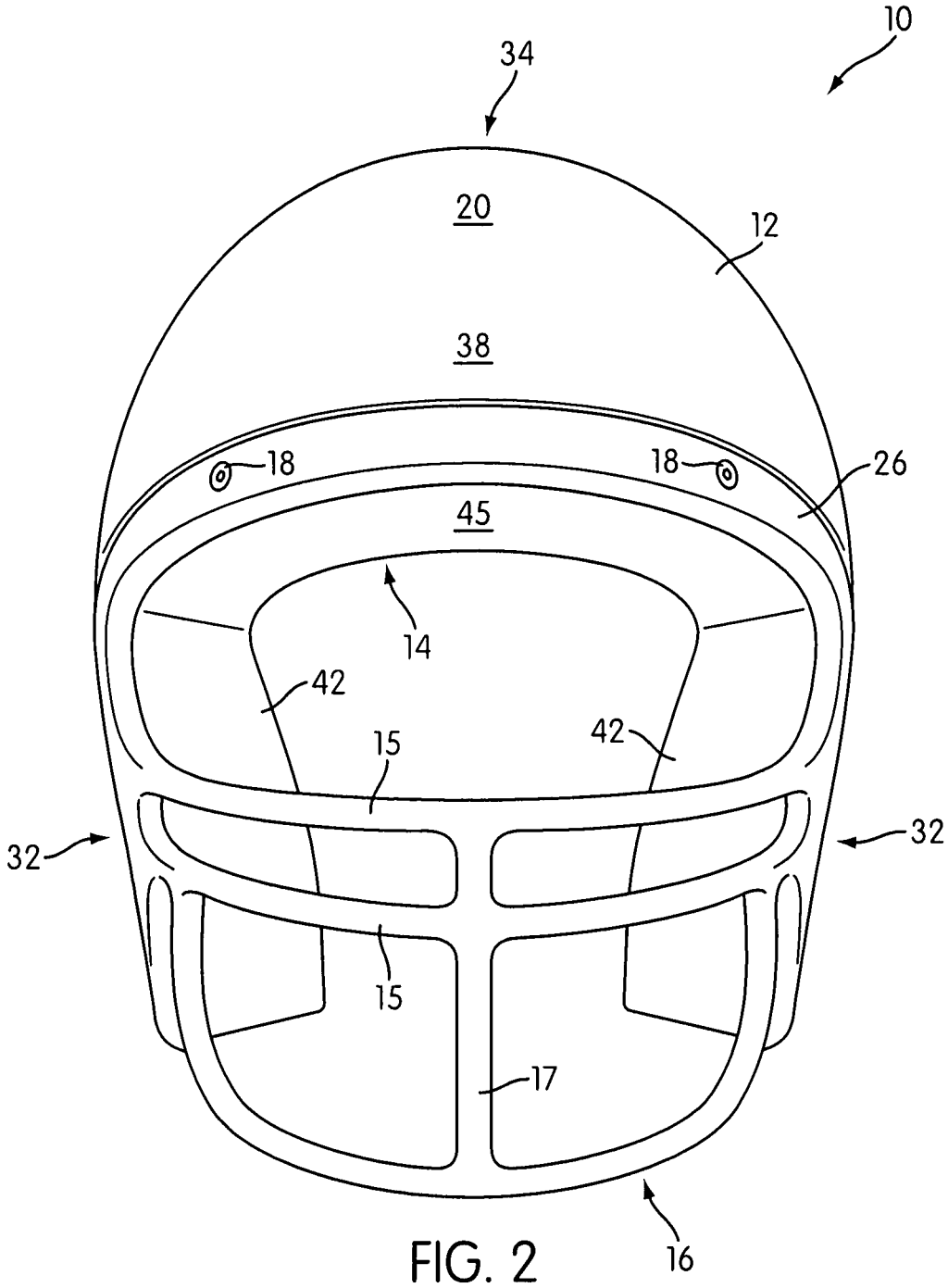
FIG. 2 is a front view of the improved athletic helmet of FIG. 1.
Figure 3:
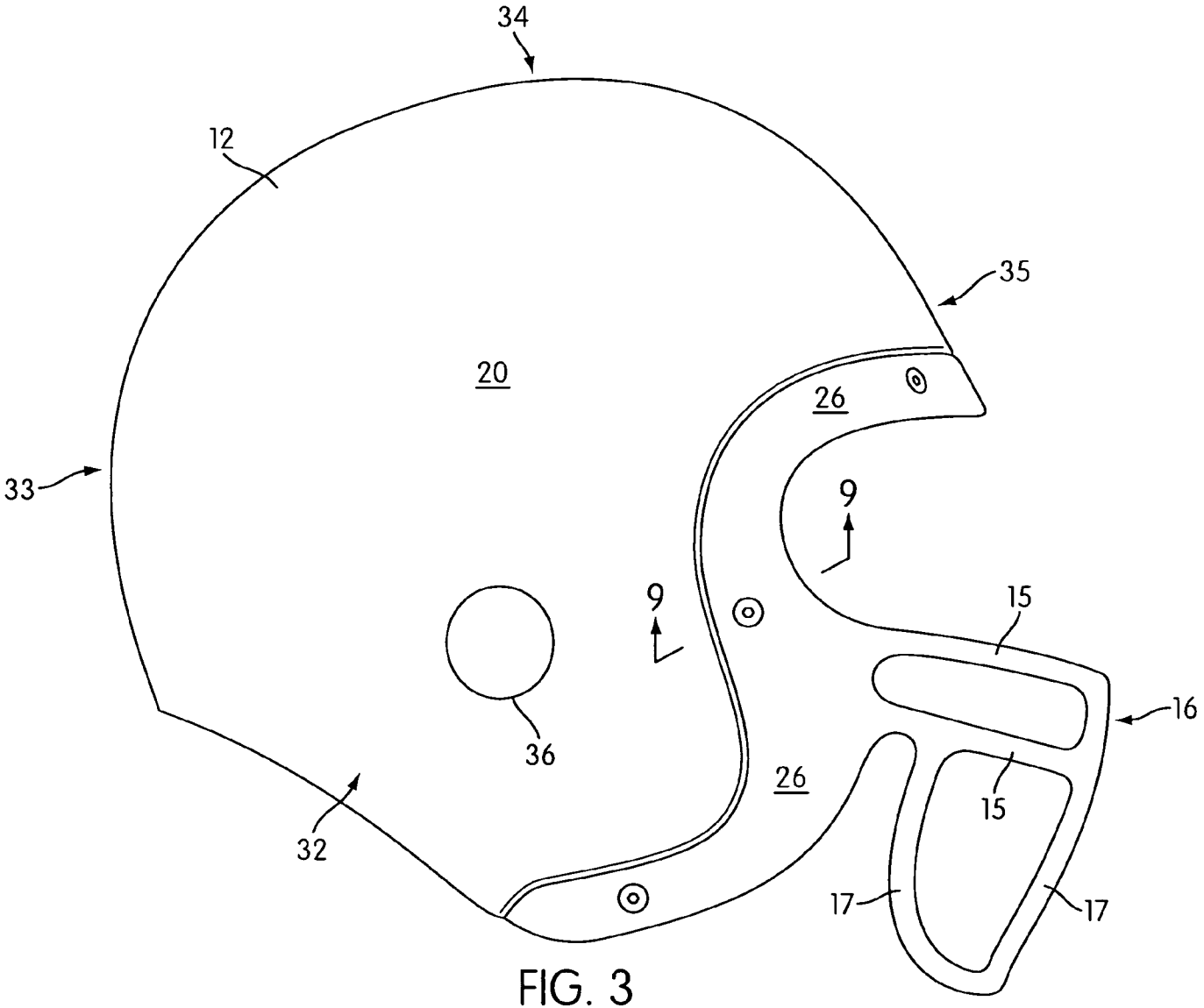
FIG. 3 is a side view of the improved athletic helmet of FIG. 1.

FIGS. 1-4 illustrate an improved athletic helmet 10 in accordance with an embodiment of the present invention comprising an outer shell 12, inner liner 14, and face mask 16. The helmet 10 is designed to absorb energy and decrease the impact of a force applied to the head, jaw, and nose of a user. It also aids in protecting the back, neck, sides, and crown of the head.

The outer shell 12 works with the liner 14 and face mask 16 to protect the head of a user or wearer, providing shock absorbent properties in the case of impact. The outer shell 12 has an exterior surface 20 and interior 22. The outer shell 12 of the helmet 10 also comprises side portions 32, a back portion 33, a top portion 34, and a front portion 35. The side portions 32 of the helmet 10 or shell 12 aid in protecting each side of the head, including the right and left ears. An ear hole or opening 36 is provided in each side portion 32. The back portion 33 assists in protecting the back and neck of the user. The top portion 34 aids in protecting the top of the head or crown of a user, and the front portion 35 is provided to protect regions such as the forehead of the user. The outer shell 12 may be made of molded plastic material, such as polycarbonate or ABS, fiber-resin composite, or other durable materials as known in the art, but should not be limited to those described.

Figure 5:
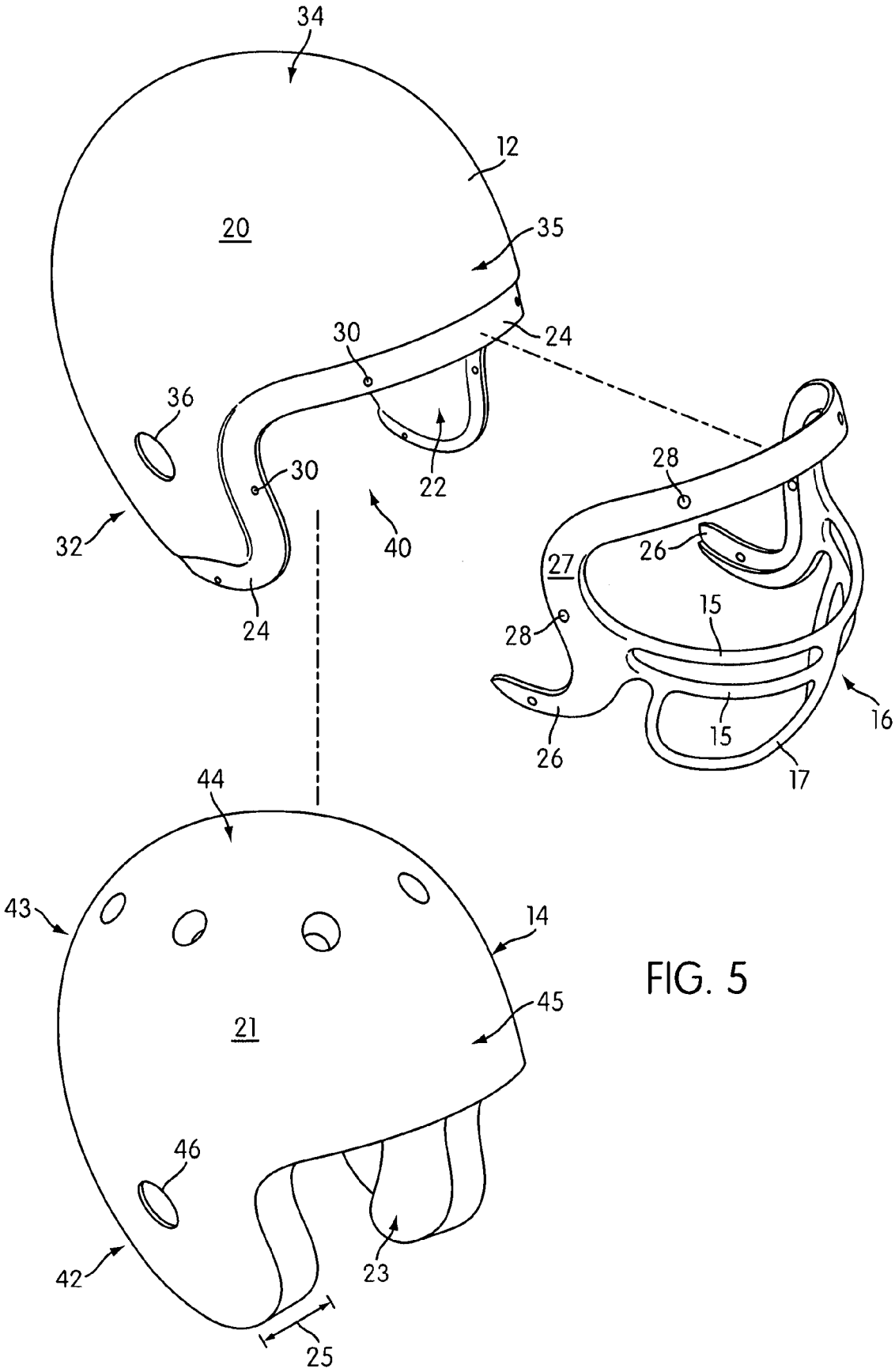
FIG. 5 is an exploded view of an outer shell, inner liner, and face mask of an improved athletic helmet in accordance with an embodiment of the present invention.
Figure 6:
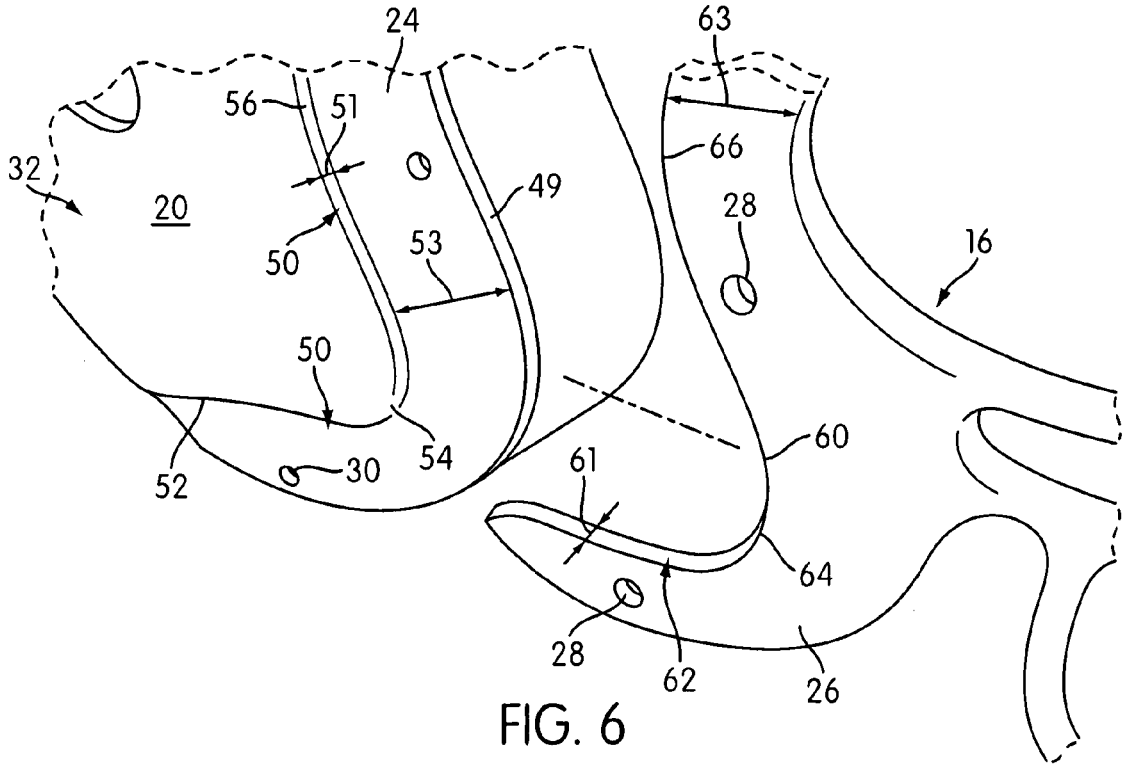
FIG. 6 is a detailed perspective view of the connection of the face mask in a recess of the outer shell of the improved athletic helmet in accordance with an embodiment of the present invention.

As better shown in FIGS. 5 and 6, the outer shell 12 also comprises a recess or stepped region 24 along its exterior 20, at an edge 49 defining a facemask opening 40. The recess or stepped region 24 is provided for attachment of the face mask 16; that is, the face mask 16 is engaged within the stepped region 24 and attached to the outer shell 12. FIG. 6 shows a detailed perspective view of side portion 32 of the outer shell 12, further showing that the exterior 20 of the outer shell 12 comprises a raised region and the recess or lower stepped region 24 formed along the edge or perimeter 49. The stepped region 24 also provides an edge 50. In an embodiment, the stepped region 24 forms a curved edge 50 and extends along an edge or perimeter 49 of the side portions 32 and front portion 35 of the outer shell 12. In an embodiment, the stepped region 24 comprises a curved edge 50 that follows a similar curvature to that of the perimeter 49 along the side and front portions 32 and 35 of the helmet 10. As best down in FIG. 8, the edge 50 of the stepped region 24 comprises a depth 51. In an embodiment, the depth 51 may be about three to about six (3 to 6) millimeters. In an embodiment, the stepped region 24 comprises a width 53. The width 53 is defined as a distance from the perimeter 49 of the outer shell 12 to the edge 50. In an embodiment, the width 53 may be about one to about three (1 to 3) centimeters.

FIG. 6 shows a detailed view of a section of the curved edge 50 of the stepped region 24 or recess. Formed near the bottom of the first side portion 32, the curved edge 50 of the stepped region 24 comprises a first portion 52 that transitions along a curved transition portion 52 into an upwardly extending curved portion 56. As shown in FIG. 5, the edge 50 and stepped region continue laterally across the front portion 35 of the exterior 20 of the shell 12. The edge 50 and stepped region 24 then curve downwardly into a curved transition portion and finally to a second portion on the bottom of the second side portion 32 (not shown).

The stepped portion 24 comprises holes or openings 30 for attaching and securing the face mask 16 using attachment devices 18 such as rivets, bolts, or screws, and securement devices 19 such as nuts. In an embodiment, any known attachment device may be used.

The inner liner 14 is attached to the interior 22 of the outer shell 12. More specifically, the exterior 21 of the inner liner 14 is attached to the interior 22 of the outer shell 12. In an embodiment, the inner liner 14 may also be removable, e.g., for purposes of replacement after wear or discoloration or for cleaning. In an embodiment, the inner liner 14 is attached and detached with respect to the outer shell 12 using known methods such as using hook and loop material, for example, but should not be limited to such. The inner liner 14 is provided to assist in cushioning the user's head and absorbing an impact force on the helmet when hit. More specifically, the interior 23 of the inner liner 14 contacts the user's head, and the inner liner 14 is provided to absorb forces that are applied to areas or portions 32, 34, or 35, for example, of the outer shell 12 of user during sport activities.

Figure 4:
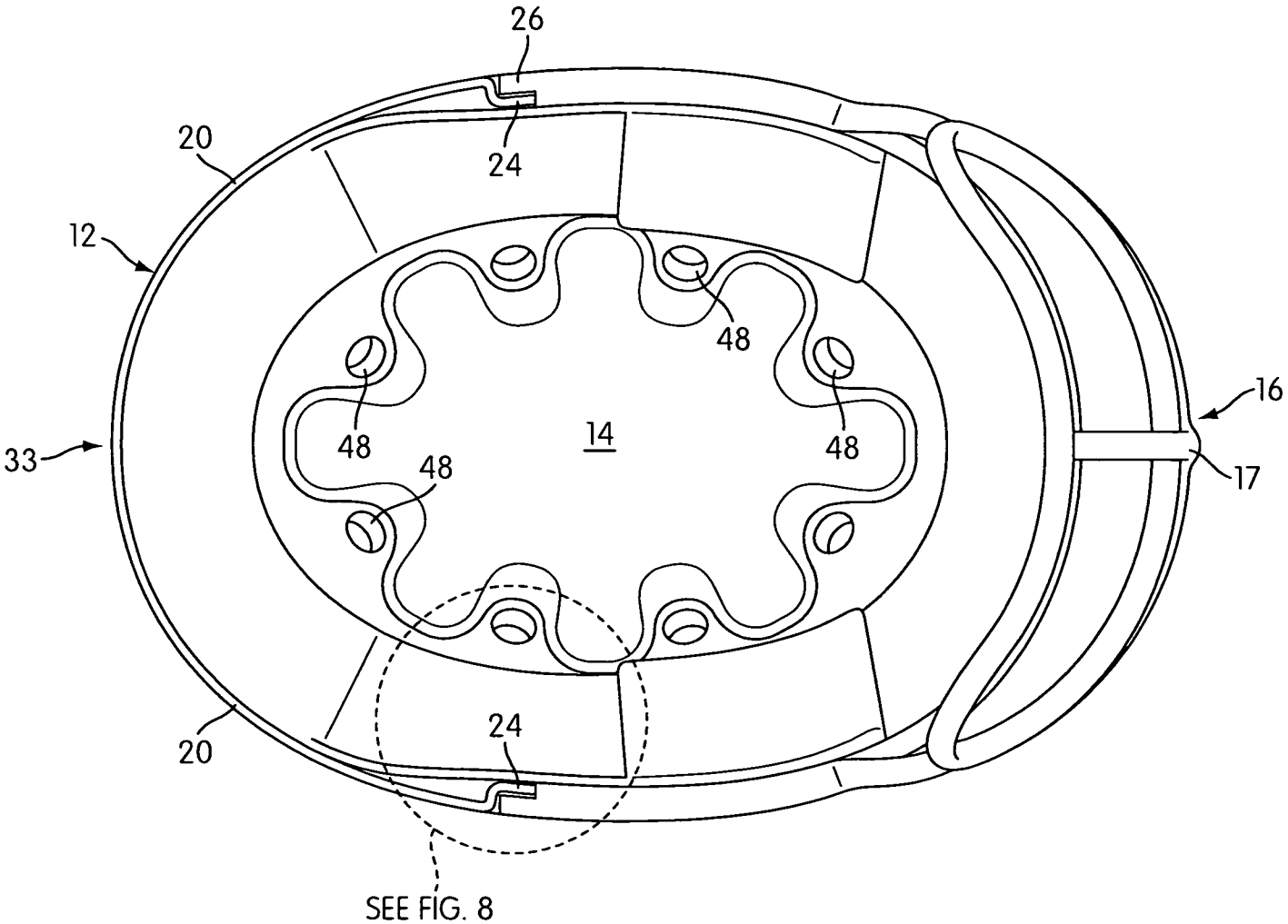
FIG. 4 is a bottom view of the improved athletic helmet of FIG. 1.

The inner liner 14 comprises side portions 42, a back portion 43, a top portion 44, and a front portion 45. Like the outer shell 12, the side portions 42 of the inner liner 14 also comprise ear holes or openings 46. In one embodiment, the side portions 42 are designed not only protect the side of the head and ears, but also aid in protecting the jaw by extending the side portions 42 below the earlobe. The back portion 43 provides cushioning to the back and neck of the user. As best shown in FIG. 4, the top portion 44 includes holes or openings 48 for air ventilation, for example. The side portions 42, top portion 44, and front portion 45 are designed to protect the jaw, crown, and forehead of the user's head.

In an embodiment, the inner liner comprises an energy absorbing material of a predetermined thickness 25. The thickness 25 of the inner liner 14 places a distance between the user's head and the outer shell 12 such that additional impact force or energy may be absorbed. In an embodiment, the thickness 25 of the inner liner 14 is custom-fit and varies according to the helmet size. In an embodiment, the thickness 25 of the liner 14 is between approximately ½ inch to 1½ inches.

In a preferred embodiment, the inner liner 14 comprises a viscoelastic foam. One benefit of using viscoelastic foam is that the foam conforms to the user's head, thus allowing for a greater contact surface and greater protection against impact forces and kinetic energy. Another benefit of using viscoelastic foam is that its energy dissipation allows for a slower rebound that the current foam used in existing helmets. In an embodiment, other known foams may be used.

Although the inner liner is shown as a single piece, in one embodiment the inner liner 14 comprises a plurality of pieces. The elasticity of the foam pieces may also vary in different parts of the helmet, e.g., depending on the specified impact requirements.

The face mask 16 is attached to the exterior surface 20 of the outer shell 12 of the helmet 10 using a flange 26 as an attachment portion, as will be further described below. The face mask 16 comprises any number of lateral bars 15 and perpendicular bars 17 for guarding and covering the lower half of the head and face. As previously noted, the face mask 16 may be attached to the outer shell 12 using attachment devices 18 and securement devices 19. The face mask 16 is provided to protect the lower portion of the face of the user; for example, the nose and mouth.

In an embodiment, the face mask 16 is designed to comprise a lightweight material. In a preferred embodiment, the face mask 16 comprises a lightweight magnesium material. The use of a lightweight magnesium material provides the required protection needed for impact forces and kinetic energy without adding substantial weight to the helmet 10. The magnesium material also allows the user to maintain a natural balance with the center of gravity of the helmet being positioned substantially centrally within the space defined by the inner line 14 for receiving the user's head. Thus, a user is able to easily maintain alignment between the head and cervical spine.

The face mask 16 shown in the Figures is of an "open cage" type. However, in an embodiment, the face mask may be of a "closed cage" type. In an embodiment, the face mask 16 may also be designed to be of any protection level—oral protection only (OPO), nose and oral protection (NOPO), eye glass and oral protection (EGOP), etc.—as known in the art. Also, the face mask style may be any that are known in the art, e.g., of double wire configuration (DW), single wire configuration (SW), reinforced (R), etc. Generally, a face mask of any style that comprises any number of bars to protect the eyes, chin, face, or other parts of a user's head may be used with the helmet 10.

Additionally, although not shown, a chin strap may be provided with the helmet 10. A chin strap is designed to help secure the helmet 10 to the user's head, as well as protect the chin (e.g., by using a chin cup or pad). Also, a chin cup or chin pad may be used with helmet 10. In an embodiment, an inflatable chin strap, for example, as disclosed in U.S. Pat. No. 6,381,757 B2 granted to the same Applicant, which is hereby incorporated by reference in its entirety, may be used with the helmet 10. In an embodiment, connections for a chin strap (e.g., snap buttons) are provided on the side portions 32 of the exterior 20 of the outer shell 12. In an embodiment, connections or attachments for a chin strap may provided on face mask 16, or in any location required for properly securing the strap. An optional mouth guard may also be provided.

As noted above, FIGS. 1 and 5 also illustrate that the face mask 16 comprises a flange 26 for engaging the stepped portion 24 and attaching to the outer shell 12. The attachment portion or flange 26 comprises an outer perimeter 60 with a first portion 62 that transitions along a curved transition portion 64 and into an upwardly extending curved perimeter portion 66. The flange 26 also comprises holes or openings 28 for receiving attachment devices 18 through an outer surface 27 for connecting to the stepped region 24 of outer shell 12.

Figure 8:
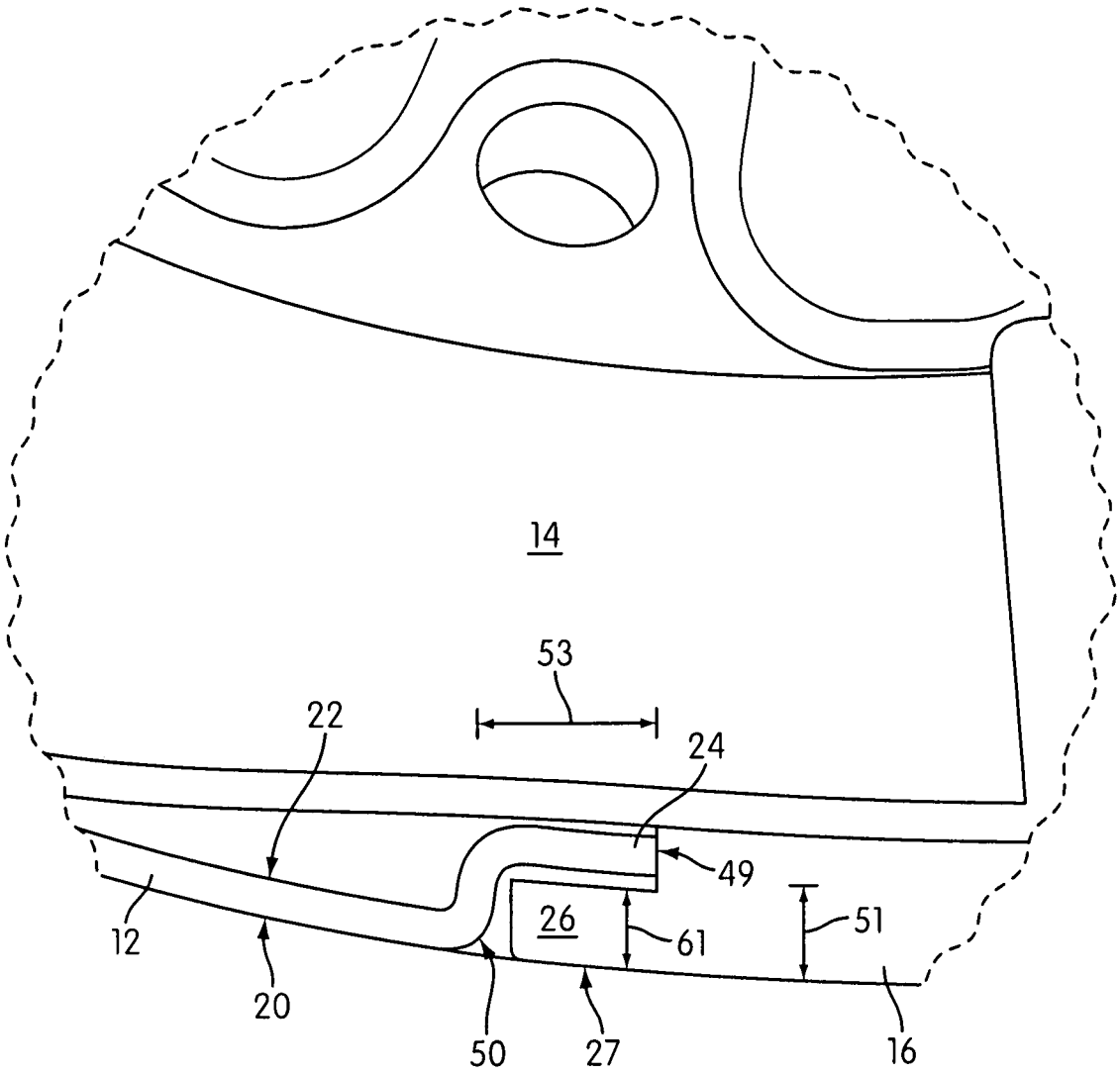
FIG. 8 is a detailed bottom view of the face mask connected in the recess of the outer shell in accordance with an embodiment of the present invention.

In an embodiment, the flange 26 comprises a predetermined thickness 61 (also shown in FIG. 8). In an embodiment, flange 26 comprises a thickness of about three to about six (3 to 6) millimeters.

In an embodiment, the depth 51 of the recess or stepped region 24 is of a substantially equal measurement to the thickness 61 of the flange 26. In an embodiment, the width 53 of the stepped region 24 is substantially equal to the width 63 of the flange 26. In an embodiment, the curved edge 50 of the stepped region 24 corresponds to the curved perimeter 60 of the flange 26. In an embodiment, the stepped region 24 comprises a depth 51 and the flange 26 has a thickness 61 that are substantially of the same dimension, such that when the flange 26 is engaged in the recess 24, the outer surface 27 of the flange 26 of face mask 16 is substantially flush with the exterior surface 20 of the outer shell 12. Thus, the curved perimeter 60 of the flange 26 of the face mask 16 is substantially flush with the curved edge 50 of the stepped region 24 of the outer shell 12.

Figure 7:
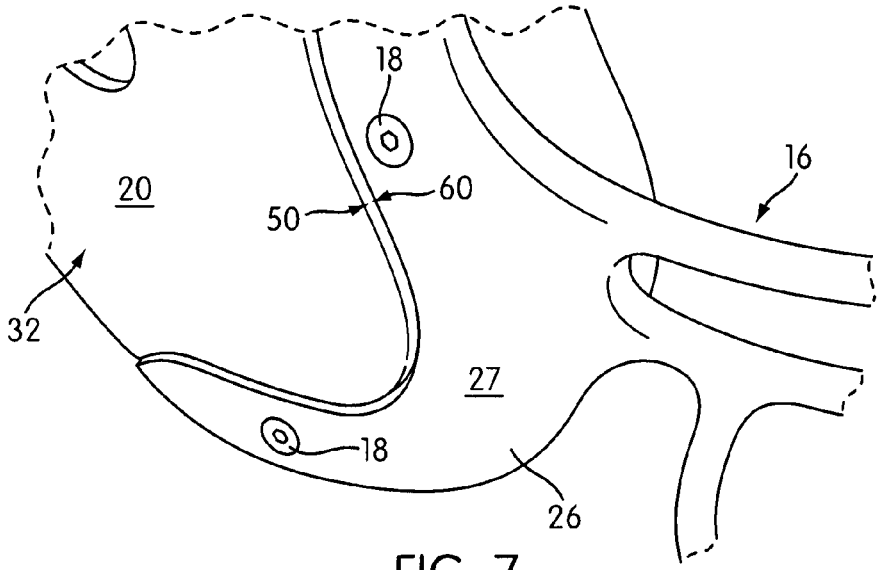
FIG. 7 is a detailed perspective view of the connected face mask and outer shell of the improved athletic helmet in accordance with an embodiment of the present invention.
Figure 9:
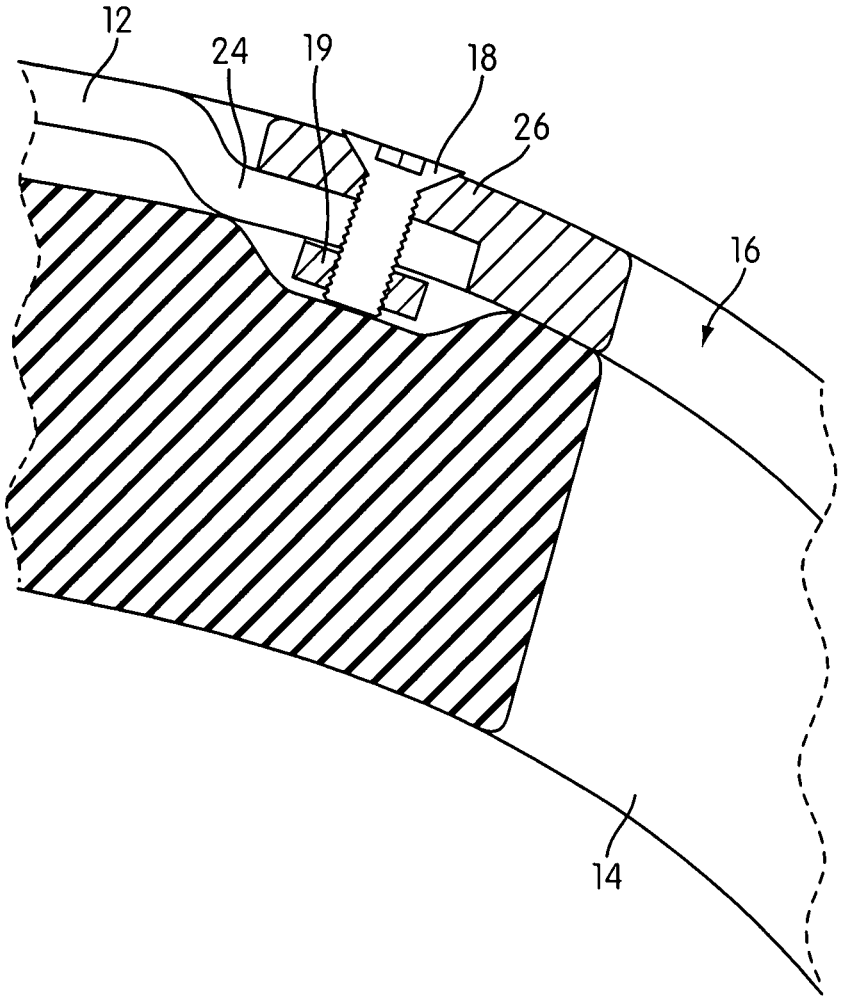
FIG. 9 is a detailed cross-sectional view of the connection of the face mask and outer shell of the improved athletic helmet of FIG. 3 in accordance with an embodiment of the present invention.

FIGS. 6 and 7 illustrate a detailed perspective view of the connection and attachment of the flange 26 of the face mask 16 in the stepped region 24 of the outer shell 12 of the improved football helmet 10 in accordance with an embodiment of the present invention. The curved perimeter 60 of the flange 26 is aligned with the curved edge 50 formed by the stepped region 24 on the side portions 32 and front portion 38 of the outer shell 12. Once the flange 26 is engaged in the stepped portion 24 and aligned, the face mask 16 is attached and secured to the exterior of the outer shell 12 using known attachment devices 18 and securement devices 19. The attachment devices 18 are fed through the openings 28 and 30, and secured with securement devices 19. As shown in FIG. 9, the securement devices 19 are hidden under inner liner 14. Inner liner 14 covers securement devices 19 such that they are not exposed for aesthetic reasons and to avoid further injury to the user's head.

The attachment of the face mask 16 to the outer shell 12 such that the exterior surface 20 of the outer shell 12 and the exterior or outer surface 27 of the flange 26 of the face mask 16 are substantially flush is advantageous as it promotes glancing blows or contact when the helmet 10 is impacted.

The features described herein should not be limited to the illustrated helmet per se. For example, the attachment method of the face mask may be used for any type of athletic helmet with a face mask, e.g., a hockey helmet, a lacrosse helmet, etc.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A helmet comprising:

an outer shell having an interior and an exterior surface, the outer shell comprising a first side portion and a second side portion, each side portion having an ear opening;

the outer shell further comprising a recess formed in the exterior surface thereof, the recess comprising a pair of curved regions comprising a first curved transition portion extending along a bottom edge of the first side portion, and a second curved transition portion extending along a bottom edge of the second side portion;

an inner liner attached to the interior of the outer shell; and a face mask, the face mask having an integral attachment portion attached to the outer shell and positioned in the recess in the exterior surface of the outer shell, the attachment portion comprising a first portion extending generally along the bottom edge on the first side portion and shaped to correspond to the recess of the first side portion, and a second portion extending generally along the bottom edge on the second side portion and shaped to correspond to the recess of the second side portion, wherein the attachment portion is attached at a point that is lower than the ear openings of the first and second side portions, and wherein the attachment portion of the face mask and the recess in the exterior surface of the outer shell are constructed and arranged such that an exterior surface of the attachment portion and the exterior surface of the outer shell are substantially flush.

2. A helmet according to claim 1, wherein the inner liner comprises a viscoelastic foam.

3. A helmet according to claim 1, wherein the face mask comprises a lightweight magnesium material.

4. The helmet according to claim 1, wherein the attachment portion of the face mask has a configuration corresponding to the curved regions.

5. The helmet according to claim 1, wherein the recess of the outer shell comprises holes therein, wherein the integral attachment portion comprises openings configured to align with the holes in the recess, and wherein the face mask is attached to the outer shell using fasteners extending through the aligned openings and holes.

6. The helmet according to claim 1, wherein the exterior surface of the attachment portion is substantially flat,

7. The helmet according to claim 1, wherein a width of the recess is substantially equal to a width of the attachment portion.

8. The helmet according to claim 1, wherein a depth of the recess is of a substantially equal measurement to a thickness of the attachment portion.

9. A helmet comprising:

an outer shell having an interior and an exterior surface, the outer shell comprising a first side portion and a second side portion, each side portion having an ear opening;

the outer shell further comprising a recess formed in the exterior surface thereof, the recess comprising a pair of curved regions comprising a first curved transition portion extending along a bottom edge of the first side portion, and a second curved transition portion extending along a bottom edge of the second side portion;

an inner liner attached to the interior of the outer shell; and a face mask, the face mask having an integrally formed attachment portion attached to the outer shell and positioned in the recess in the exterior surface of the outer shell, wherein the integrally formed attachment portion is attached at a point that is lower than the ear openings of the first and second side portions, and wherein an outwardly facing exterior surface of the attachment portion is substantially flat.

10. The helmet according to claim 9, wherein the recess of the outer shell comprises holes therein, wherein the integral attachment portion comprises openings configured to align with the holes in the recess, and wherein the face mask is attached to the outer shell using fasteners extending through the aligned openings and holes.

11. The helmet according to claim 9, wherein the attachment portion of the face mask has a configuration corresponding to the curved regions.

12. The helmet according to claim 9, wherein the attachment portion of the face mask and the recess in the exterior surface of the outer shell are constructed and arranged such that an exterior surface of the attachment portion and the exterior surface of the outer shell are substantially flush.

13. The helmet according to claim 9, wherein a width of the recess is substantially equal to a width of the attachment portion.

14. The helmet according to claim 9, wherein a depth of the recess is of a substantially equal measurement to a thickness of the attachment portion.

15. A helmet comprising:

an outer shell having an interior and an exterior surface, and a first side portion and a second side portion each including ear openings therein;

an inner liner attached to the interior of the outer shell; and a face mask, the face mask having an integral attachment portion attached to a recess in the exterior surface of the outer shell at a point that is lower than each ear opening of the helmet;

the recess of the outer shell extending at least along a bottom edge of each of the first and second side portions and comprising holes therein, and the face mask comprising openings in its integral attachment portion that are configured to align with the holes of the recess;

the attachment portion further comprising a first portion extending generally along the bottom edge on the first side portion and shaped to correspond to the recess of the first side portion, and a second portion extending generally along the bottom edge on the second side portion and shaped to correspond to the recess of the second side portion, the attachment portion being attached at a point that is lower than the ear openings of the first and second side portions; and fasteners that attach the face mask to the outer shell, the fasteners extending through the aligned openings and holes wherein an exterior surface of the attachment portion is substantially flat.

16. The helmet according to claim 15, wherein the fasteners are selected from the group consisting of: rivets, bolts, screws, and nuts.

* * * * *